US006508309B1

(12) United States Patent
French

(10) Patent No.: US 6,508,309 B1
(45) Date of Patent: Jan. 21, 2003

(54) VALVE ASSEMBLY

(75) Inventor: Clive John French, James (BE)

(73) Assignee: Quartech Engineering Limited (GB)

( * ) Notice: Subject to any disclaimer, the term of this patent is extended or adjusted under 35 U.S.C. 154(b) by 0 days.

(21) Appl. No.: 09/575,325

(22) Filed: May 19, 2000

(30) Foreign Application Priority Data

May 19, 1999 (GB) ..... 9911545

(51) Int. Cl.[7] ..... E21B 34/14
(52) U.S. Cl. ..... 166/323; 166/324; 166/332.8
(58) Field of Search ..... 166/319, 321, 166/324, 332.8, 323

(56) References Cited

U.S. PATENT DOCUMENTS

| | | | | |
|---|---|---|---|---|
| 5,251,702 A | * | 10/1993 | Vazquez | 166/324 |
| 5,484,022 A | * | 1/1996 | Coutts et al. | 166/336 |
| 6,079,497 A | * | 6/2000 | Johnston et al. | 166/324 |
| 6,230,808 B1 | * | 5/2001 | French et al. | 166/323 |

FOREIGN PATENT DOCUMENTS

| | | |
|---|---|---|
| GB | 2 272 774 A | 5/1994 |
| GB | 2309723 A | 8/1997 |
| GB | 2312909 A | 11/1997 |
| GB | 2337544 A | 11/1999 |
| WO | WO 98/50678 | 11/1998 |

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

A downhole valve assembly (10) comprises a tubular body (12), and a valve comprising a valve member (18) and a fluid actuated valve control mechanism (14) adapted to be selectively actuated to move the valve member between an open and a closed configuration, for selectively allowing fluid flow through the body (12). A first hydraulic control conduit (41) is in fluid communication with the valve control mechanism (14) for permitting actuation Of the control mechanism to move the valve member (18) to the open configuration, by application of a first control fluid. A second hydraulic control conduit (41) is in fluid communication with the valve control mechanism (14) to move the valve member (18) to the closed configuration, by application of a second control fluid.

21 Claims, 5 Drawing Sheets

VALVE ASSEMBLY

FIELD OF THE INVENTION

The present invention relates to a valve assembly. In particular, but not exclusively, the present invention relates to a valve assembly for location in a borehole of a well.

BACKGROUND OF THE INVENTION

When it is desired to carry out work on a partially or fully cased borehole of an oil or gas well there is a requirement for provision of an isolation barrier in the bore, which barrier may take the form of a valve, or a dense or "weighted" fluid. Also, when tubing is installed on a production well, and the well is "completed", health and safety regulations require that a barrier, typically referred to a "safety" valve, is installed as part of the completion.

In the course or drilling a well, the bore will pass through formations of different porosities and containing fluids at different pressures. Surveys will have been carried out with the aim of predicting the properties of the different formations, and the density of the column of drilling fluid or mud being circulated in the bore during the drilling operation is typically selected such that the fluid pressure in the bore is slightly higher than the formation fluid which is expected to be encountered. However, there is always a risk that a formation will be at a higher or lower pressure than anticipated, or that different formations intersected by a single bore will be at significantly different pressures. If the bore intersects an unexpectedly low pressure formation, there may be a significant loss of drilling mud into the formation, at great expense to the drilling operator, and if the formation is gas or oil-bearing such an influx of mud may result in significant damage to the production capabilities of the formation on the other hand, encountering an unexpectedly high pressure formation, creating a "kick" in the bore, may result in a sudden influx of formation fluid to the bore, with potentially disasterous consequences.

There are various established steps and operations which may be implemented to control such situations. In some cases, it may be possible to chemically treat or plug a porous or low pressure formation, or to circulate higher density drilling fluid to prevent or limit influx of fluids from a high pressure formation. However, these procedures tend to be time consuming and expensive, and in some cases the condition may be such, for example a sudden high pressure or high volume influx, that the well must be capped and abandoned. If time and conditions permit, it may be possible to isolate a problem formation by running casing into the bore. However, each string of casing that is run into a bore reduces the available bore diameter, and running casing earlier than predicted will restrict the available bore diameter, possibly to the extent that the well cannot be completed, and also limits the possiblities for running subsequent casing strings in the event of further problem formations being encountered.

In a completed well that has been producing for some time, it is not unusual for corrosion or erosion of well components to occur, such that the tubing must be retrieved to permit refurbishment and repair, or "work over" of the well. Clearly, the flow of production fluid from the well must be halted during work over. Generally, it in preferred to do this by isolating the lower end of the bore, which intersects the producing formation, by installing a plug in the lower end of the tubing; the tubing above the plug may then be removed. However, erosion and the build up of scale and other deposits in the tubing may make it impossible to set a plug in the tubing. Accordingly, it may then be necessary to "kill" the well, by filling the bore with relatively dense fluid, the hydrostatic pressure produced by the column of fluid preventing the production fluid from flowing into the bore. However, killing a well often contaminates or damages the producing formation, and may even reduce the production capabilites of the formation to the extend that the well is no longer commercially viable.

It is amongst the objects of the present invention to obviate or mitigate at least one of the foregoing disadvantages.

SUMMARY OF THE INVENTION

According to a first aspect of the present invention there is provided a well operating method comprising:

providing a valve in a tubing string;

running the tubing string into a cased bore;

sealing the tubing string in the cased bore;

closing the valve to isolate the lower end of the bore;

uncoupling the tubing string from the valve;

retrieving the tubing string;

running a replacement tubing string into the bore;

coupling the replacement tubing string to the valve; and opening the valve to permit fluid communication between the lower end of the bore and the tubing string.

The invention thus permits well work over and the like without the requirement to run a plug or kill the well. The references to a cased bore and intended to encompass a drilled bore which has been lined or partially lined with casing, liner or other form of bore wall support or sealing arrangement.

The valve may also be utilised to assist in the running of the tubing, in the setting of packers, in testing of the tubing, and to allow circulation of a fluid cushion. The valve may then be opened, until it becomes necessary to isolate the lower portion of the bore.

Preferably, the tubing string is a production tubing string.

Preferably, the valve is located towards the lower end of the tubing string.

Preferably, the tubing string is sealed in the cased bore by a packer, which is preferably located adjacent the valve. The packer may be located above or below the valve.

According to another aspect of the present invention there is provided a bore-drilling method comprising:

providing a valve in bore-lining casing;

advancing the bore by drilling using a drill string passing through the valve;

retrieving the drill string through the valve;

closing the valve to isolate the lower end of the bore; and opening the valve to reestablish fluid communication with the lower end of the bore.

This aspect if the invention is useful in dealing with "kicks" or other problems encountered while drilling. In the event of a kick, the drill string may be pulled back to above the valve and the valve closed. Thus, the problem formation may be isolated relatively quickly. With the protection of the valve in place the well may be circulated to the required mud weight, the valve then opened and the well returned to a controlled situation.

Preferably, the method further comprises the step of monitoring the bore for conditions indicative the bore encountering a problem formation. Such monitoring may include pressure monitoring, mud gas analysis, or any known monitoring method.

According to a still further aspect of the present invention provides a valve assembly for location in a borehole of a well, the assembly comprising:

a hollow elongate member for location in the borehole;

a valve comprising a valve member and a fluid actuated valve control mechanism adapted to be selectively actuated to move the valve member between an open and a closed configuration, for selectively allowing fluid flow through the hollow member;

a first hydraulic control conduit in fluid communication with the valve control mechanism for permitting actuation of the control mechanism to move the valve member to the open configuration, by application of a first control fluid; and a second hydraulic control conduit in fluid communication with the valve control mechanism to move the valve member to the closed configuration, by application of a second control fluid.

Preferably the valve assembly is adapted to form part of or to be mounted to a string of tubular members. The tubular members may be bore-lining casing or liner, production tubing, drill tubing or drill pipe, or the like.

One or both of the first and second control fluids may be a hydraulic fluid, Alternatively, the control fluids may be well fluids.

Preferably, the hollow elongate member is tubular.

Preferably, the valve is adapted to contain pressure from both above and below.

The valve member may comprise a plate, generally circular in plan and arcuate in profile. The plate may be disposed in an annular or part annular cavity in a wall of the hollow member when the valve is in the open configuration, and is preferably isolated in the cavity, to protect the plate from well fluids and debris. Alternatively, where the hollow member does not have to serve as a pressure barrier to one side of the closed valve member, the wall of the hollow member may define an aperture to receive the open valve member, increasing the available internal diameter. In the closed configuration, the plate may be disposed substantially perpendicularly to the wall of the hollow member.

Preferably, the valve control mechanism comprises a plurality of fluid actuated movable elements, and most preferably the elements are adapted to move in a predetermined sequence in response to exposure to a common fluid pressure. Conveniently, this is achieved by the elements defining different, staggered piston areas, such that the pressure forces experienced by the elements are different.

Preferably, the valve control mechanism comprises one or more elements each defining oppositely acting piston areas in communication with respective control conduits, a differential fluid pressure force in one direction tending to move the element in that direction. The pistons may be located in respective chambers and the flow of fluid from the chambers may be controlled to control piston movement; if the chamber contains an incompressible fluid, the piston will not prove unless fluid can flow from the chamber.

The valve may be actuated between the open and closed configurations by the selective application of control fluid through a selected one of the first and second control conduits, whilst simultaneously removing fluid via the other one of said first and second control conduits.

One or both of the first and second control conduits may be adapted to extend out of the borehole, with the fluid control and supply apparatus being located at surface. Alternatively, supply of fluid to the conduits may be controlled by downhole valves, which may form part of a control unit. The valves may provide selective communication with tubing fluid, or annulus fluid, or fluid supplied from surface. The valves may be controlled by any appropriate means, for example by signals communicated via control lines from surface or remotely from surface, such as by radio or audio signals, pressure pulses or pressure cycling, or in response to sensed downhole conditions, for example a sudden loss or increase in tubing pressure. The control unit may be located above or below a packer positioned between tubing and casing or liner.

Preferably, the valve assembly further comprises a bypass vent which is selectively openable to permit flow between the interior and exterior of the hollow member on opening and closing of the valve member to provide a fluid path around the valve member. Thus, as the valve member is opened or closed, fluid pressure or flow may bypass the valve member. The valve member and valve seat thus do not experience the wear and erosion that would otherwise occur when the valve member was only partially open and impair the ability of the valve member to create an effective seal.

According to a yet further aspect of the present invention provides a valve assembly for location in a borehole of a well, the assembly comprising:

a hollow elongate member for location in the borehole;

a valve comprising a valve member and a fluid actuated valve control mechanism adapted to be selectively actuated to move the valve member between an open and a closed configuration, for selectively allowing fluid flow through the hollow member, the valve control mechanism comprising a plurality of fluid actuated movable elements adapted to move in a predetermined sequence in response to exposure to a common fluid pressure.

This aspect of the invention provides for an additional degree of control of downhole valves, and may equally be applied to other downhole devices.

Conveniently, the sequential movement of the elements is achieved by the elements defining different piston areas, such that the pressure forces experienced by the elements are different.

According to a yet further aspect of the present invention provides a valve assembly for location in a is borehole of a well, the assembly comprising:

a hollow elongate member for location in the borehole;

a valve comprising a valve member and a fluid actuated valve control mechanism adapted to be selectively actuated to move the valve member between an open and a closed configuration;

a bypass vent being selectively openable to permit an alternative flow path around the valve member on closing of the valve member to provide a fluid path around the valve member.

BRIEF DESCRIPTION OF THE DRAWINGS

Embodiments of the present invention will now be described, by way of example, with reference to the accompanying drawings, in which.

DETAILED DESCRIPTION OF THE DRAWINGS

Figure 1:
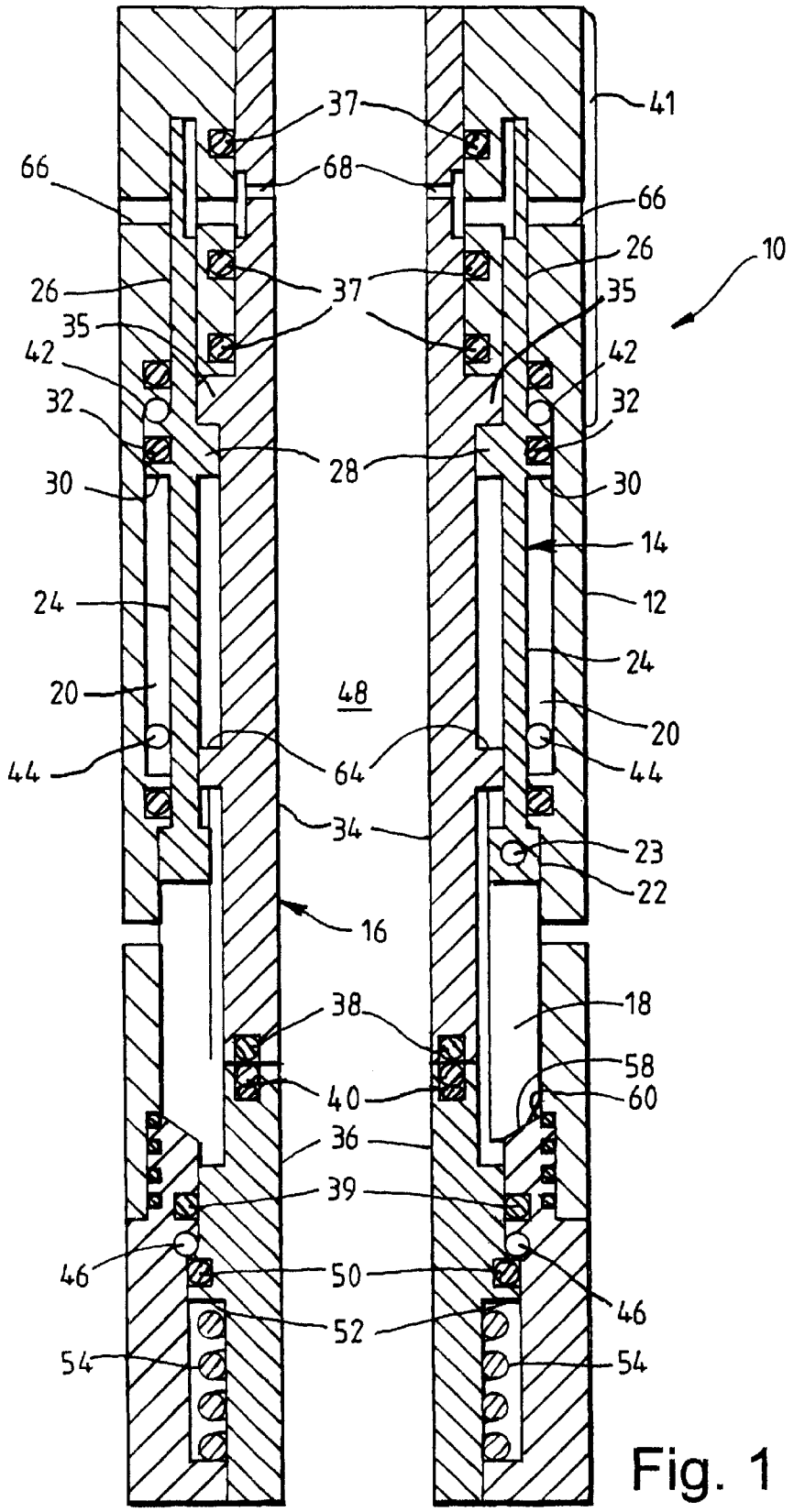
FIG. 1 is a longitudinal cross-sectional view of a valve assembly, in accordance with an embodiment of the present invention, shown with a valve member of the valve assembly in an open configuration.

Referring firstly to FIG. 1, there is shown a longitudinal cross-sectional view of a valve assembly in accordance with an embodiment of the present invention, shown in an open configuration, and indicated generally by reference numeral 10.

The valve assembly 10 comprises a tubular housing 12, an annular piston member, indicated generally by reference numeral 14, a sleeve assembly 16 and a hinged valve flap 18.

The housing 12 is shaped to define, together with the sleeve assembly 16, an annular cavity 20 which extends axially along the housing 12. The piston member 14 comprises a leading end 22 to which the valve flap 18 is pivotally coupled, a tubular body portion 24 extending through the cavity 20, and a tail portion 26 uppermost in the housing 12. Shoulders 28 and 30 extend radially inwardly and outwardly respectively from the body portion 24, and a seal 32 is disposed in the shoulder 30, to seal the piston member 14 to the housing 12.

The sleeve assembly 16 comprises upper and lower sleeves 34 and 36, each having respective opposed seals 39 and 40. Hydraulic control lines 41 are coupled to the housing 12 and supply hydraulic fluid to actuate the assembly 10 through inlet ports 42, 44 and 46, and to selectively inject or withdraw fluid from the assembly 10, as will be described in more detail below. The control lines 41 may extend to surface, or may extend to a remotely controllable downhole control unit, where selectively actuatable valves may permit fluid communication between the conduits 41 and the tubing bore or the annulus.

The valve assembly 10 is located in a production tubing string and run into a casing-lined borehole, to selectively isolate the lower end of the borehole, particularly when it is desired to carry out well work over operations above the assembly. The assembly 10 may be run into the casing-lined borehole in the open configuration shown in FIG. 1, or in the closed configuration shown in FIG. 2.

Figure 2:
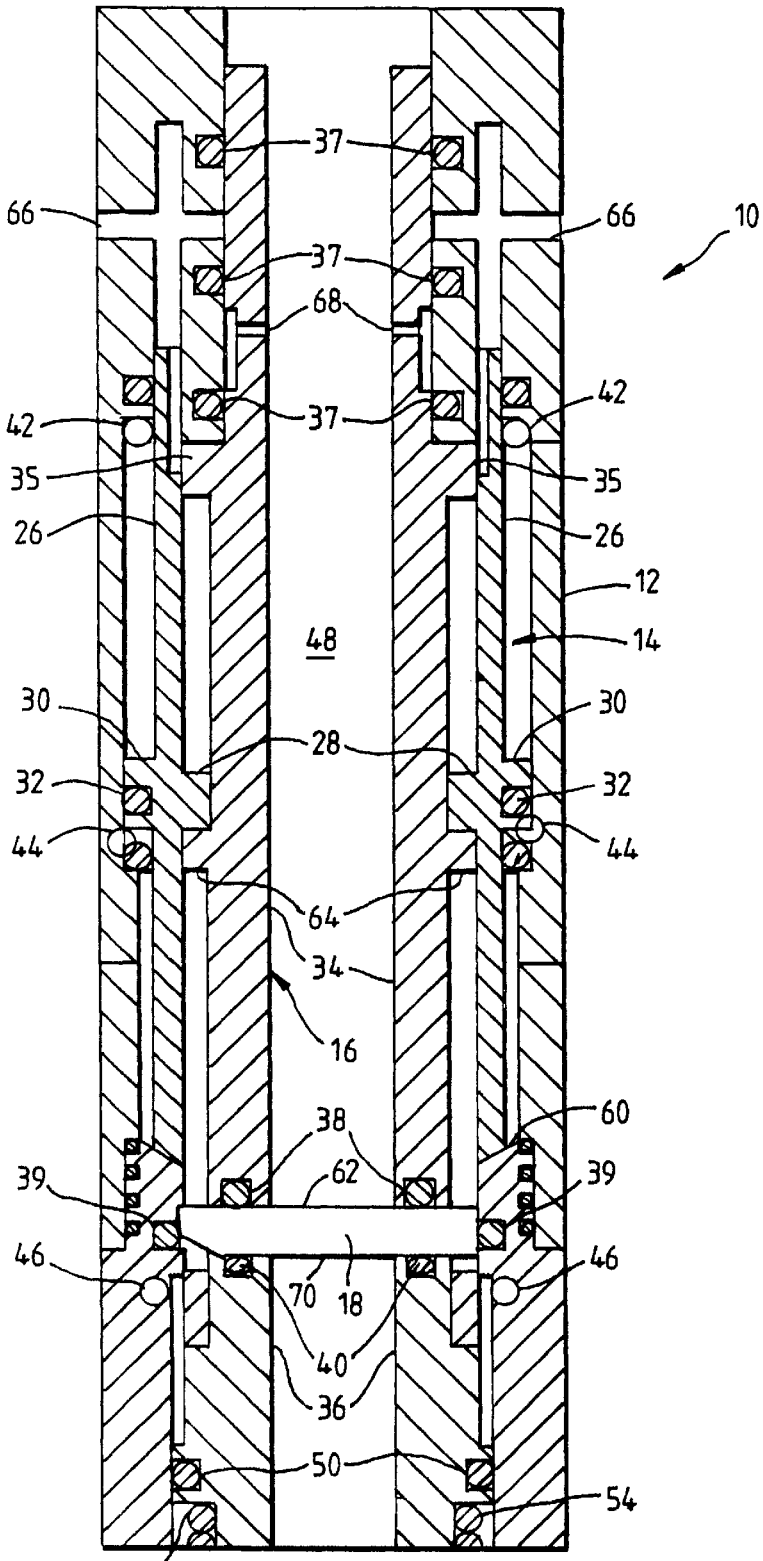
FIG. 2 is a view of the valve assembly of FIG. 1, shown with the valve member in a closed, sealed configuration.

In the closed configuration, the valve flap 18 is disposed substantially perpendicularly to a longitudinal axis of the housing 12, and is in sealing contact with the sleeves 34 and 36, as shown in FIG. 2. The upper and lower sleeves 34 and 36 are themselves sealed to the housing 12, via seals 37 in the portion of the housing 12 adjacent to the upper sleeve 34, and seals 39 in the portion of the housing 12 adjacent to the sleeve 36, thus fluidly isolating the tubing bore 48. Also, when the assembly 10 is in the closed, sealed, configuration shown in FIG. 2, fluid pressure in the tubing bore 46 acting upon the upper sleeve 34 assists in maintaining the sealing arrangement of the valve assembly 10. This is due to the fact that the seal 37 is of a larger diameter than the seal 38 at the lower end of the upper sleeve 34, creating a differential pressure force on the sleeve 34, forcing it downwards to maintain sealing with the valve flap 18. Similarly, fluid pressure in the housing 12 below the valve flap 18 forces the lower sleeve t6 upwardly to maintain sealing with the valve flap 18, due to the difference in diameter between the seal 40 and the inside of the housing 12 below the sleeve 36.

Figure 3:
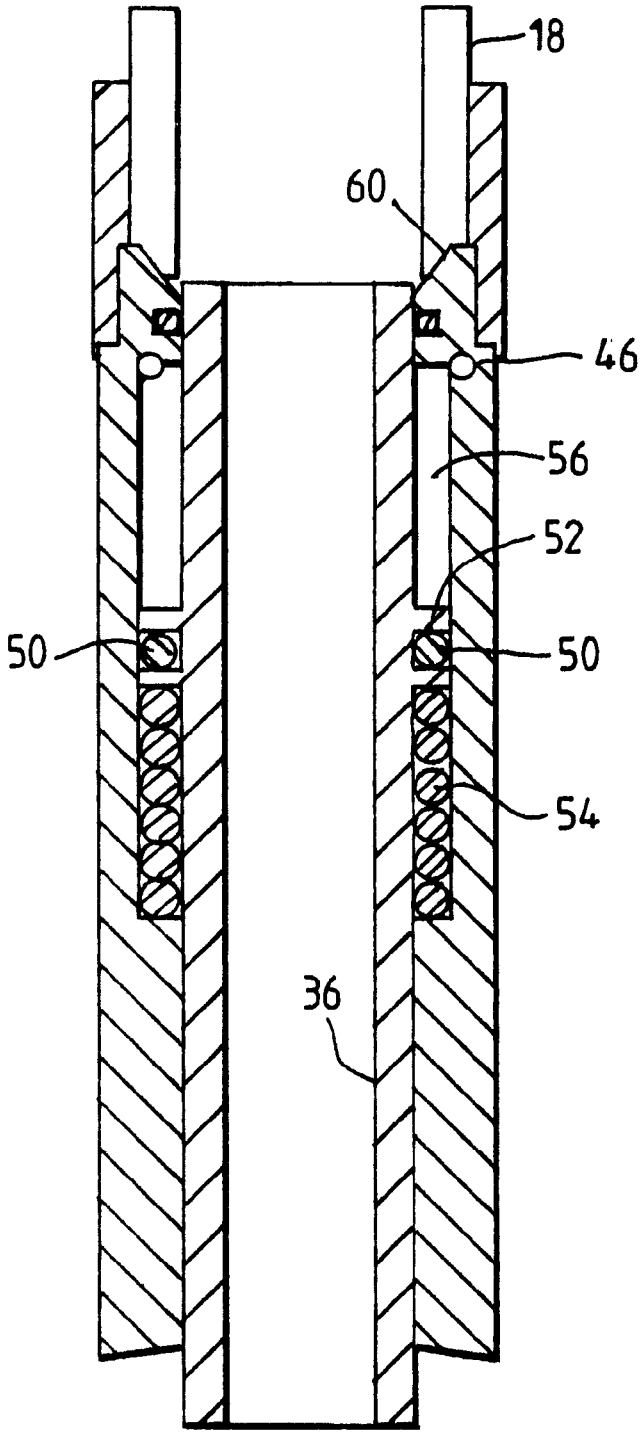
FIG. 3 is a longitudinal cross-sectional view of part of the valve assembly of FIG. 1, drawn to an alternative scale.
Figure 4:
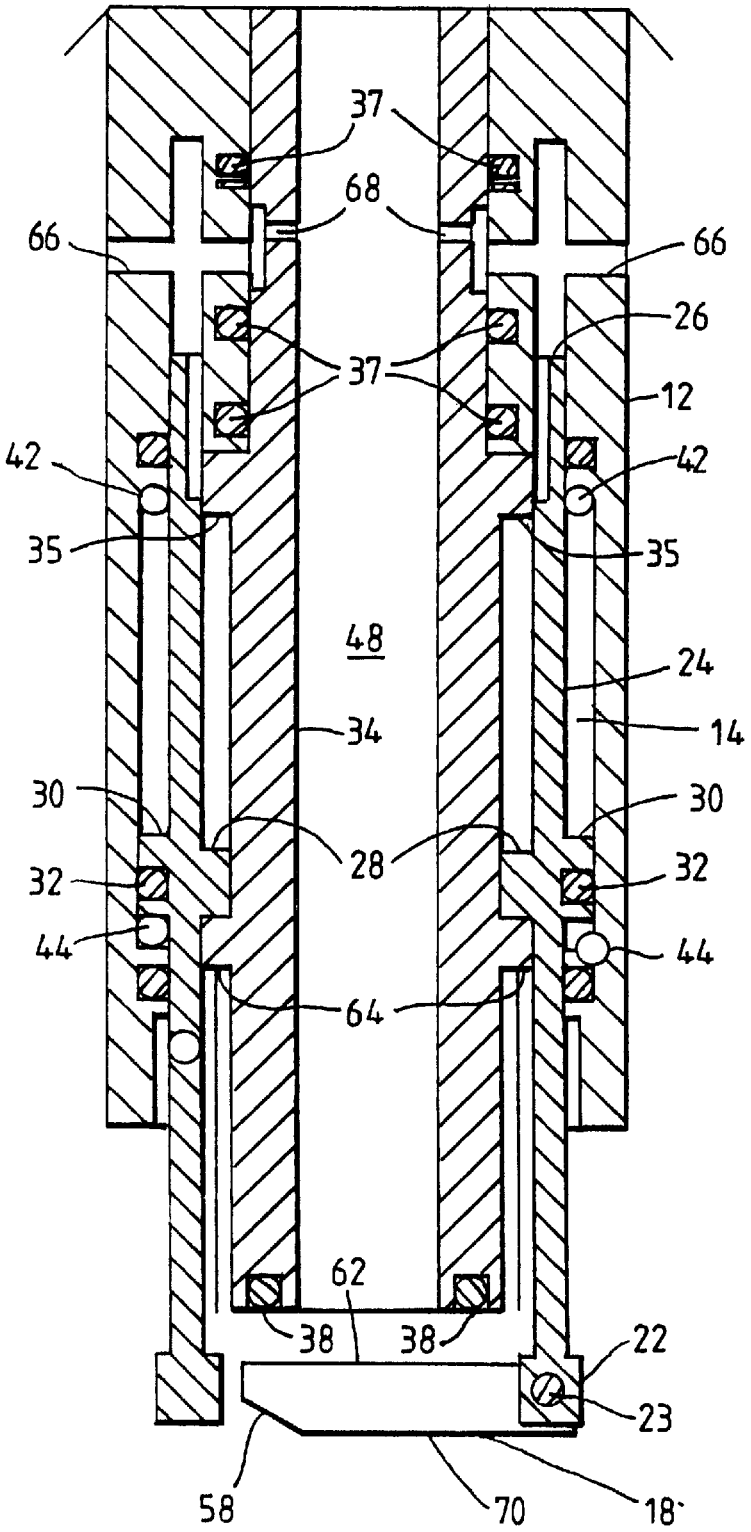
FIG. 4 is a longitudinal cross-sectional view of part of the valve assembly of FIG. 2, shown immediately is prior to actuation to the closed sealed configuration of FIG. 2, and drawn to an alternative scale.
Figure 5:
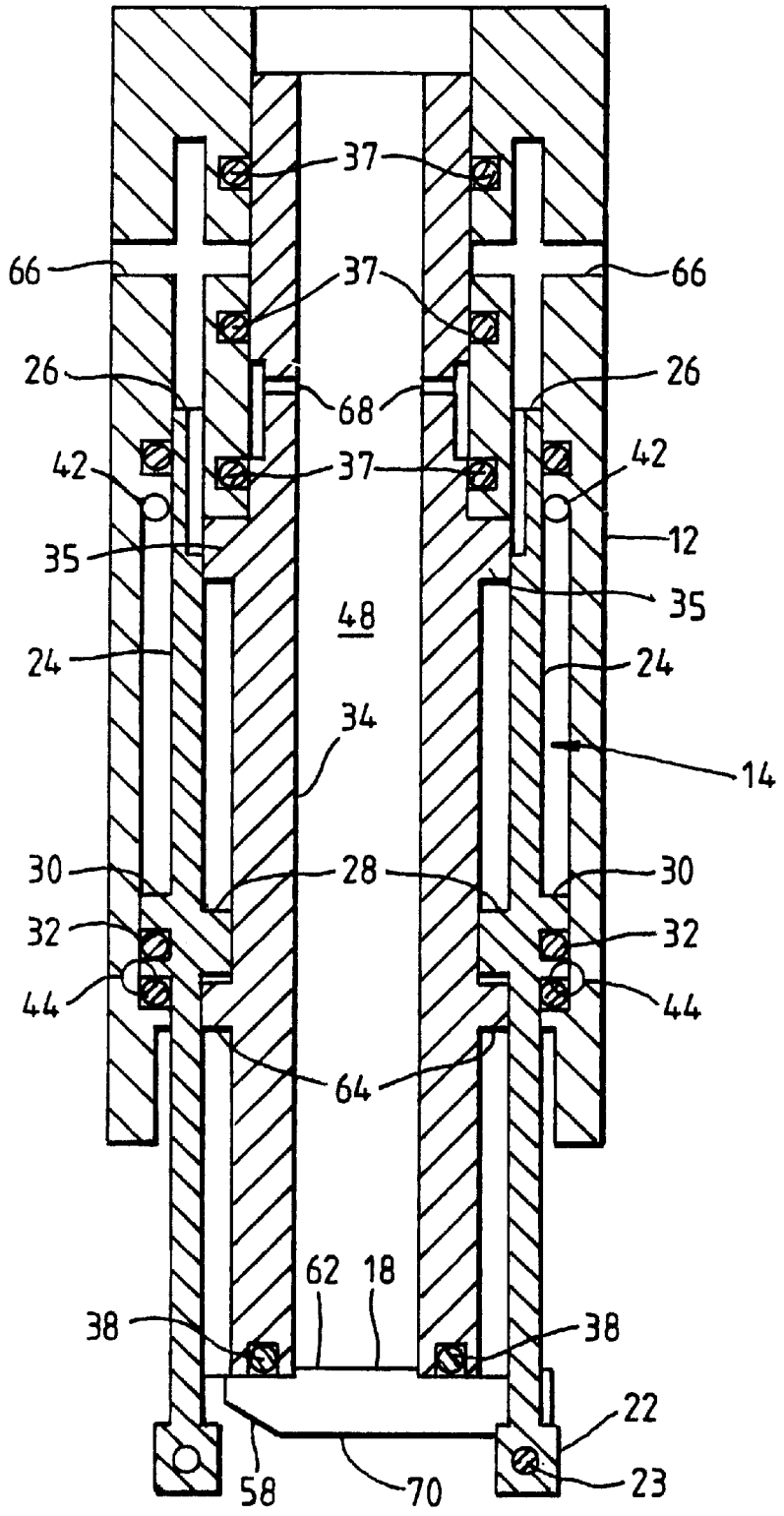
FIG. 5 is a view of the part of the valve assembly shown in FIG. 4, with the valve of the valve assembly shown in the closed, sealed configuration of FIG. 2.

FIGS. 3 to 5 are longitudinal cross-sectional views of parts of the valve assembly 10 shown in FIGS. 1 and 2, which illustrate the various steps involved in actuating the valve assembly 10 between the open and closed configurations of FIGS. 1 and 2 respectively.

Referring firstly to FIG. 3, there it shown the lower sleeve 36 of the assembly 10 in a retracted configuration. The lower sleeve 36 includes a seal 50 for sealing the sleeve 36 to the housing 12, the seal being mounted in a shoulder 52 extending radially outwardly from the sleeve 36. A lower face of the shoulder 52 abuts a compression spring 54, which, in the absence of fluid pressure, maintains the sleeve 36 in an upper position, as shown in FIG. 1. The sleeve 36 may be actuated to the retracted configuration to allow the valve flap 18 to move to the closed configuration, as shown in FIG. 2. This is achieved by supplying control fluid to the port 46 and into the cavity 56, causing the sleeve 36 to move axially downwardly, compressing the spring 54, and moving to the position shown in FIG. 3. This enables the valve flap 18 to move to the closed configuration, as will be described below.

Referring now to FIG. 4, there is shown the housing 12 excluding the sleeve 36 of FIG. 3, before the closed valve flap 18 comes into sealing contact with the seals 38 and 40 of the upper and lower sleeves 34 and 36. One of the control lines 41 is coupled to the housing 12 such that fluid is supplied simultaneously to the ports 42 and 46. The lower sleeve 36 is actuated to the retracted configuration shown in FIG. 3 at a lower applied pressure than the piston member 14, due to the different effective areas of the sleeve and piston member. Thus by gradually increasing the pressure of the actuating fluid, the lower sleeve 36 can be actuated to the retracted configuration before the piston member 14 moves down to move the valve flap 18 to the closed configuration shown in FIG. 2.

To allow the piston member (and thus the upper sleeve 36) to move to the closed Configuration shown in FIG. 2, control fluid is withdrawn through, or bled off from, the port 44, via a respective control line 41, whilst supplying control fluid to the port 42 to move the piston member 14 axially downwardly to the position shown in FIG. 4. Meanwhile, the valve flap 18 pivots about the leading end 22 of the piston member 14, and extends across the bore 48. To facilitate the desired pivoting movement of the flap 18, a bevelled face 58 is provided on the valve flap 18, which face moves over a similar bevelled face 60 of the housing 12 (not shown in FIG. 4) . When the valve flap 18 has extended to the closed position, the valve flap 18 resides with a lower face 70 of the flap 18 adjacent to and in contact with the seals 40 of the lower sleeve 36. The upper sleeve 34 then moves down into contact with an upper face 62 of the valve flap 18, as shown in FIG. 2.

The movement of the upper sleeve 34 is achieved by moving the piston member 14 axially downwardly, until the shoulder 28 of the piston member 14 sooner into contact with a radially outwardly extending shoulder 64 of the sleeve 34. Further downward movement of the piston member 14 thus causes the sleeve 34 to be driven co-axially downwardly, towards the valve flap 18, The valve flap 18 includes an axially extending slot, and is mounted to the end 22 of the piston member 14 via a pin 23, This allows the valve flap 18 to remain axially stationary while the upper sleeve 34 is being moved downwardly by the piston member 14. The sleeve 14 is tarried down until the seals 38 come into contact with the face 62 of the valve flap 18.

The housing 12 includes flow ports 66 extending radially through the housing 12, the valve assembly being adapted to allow fluid communication between the tubing bore 48 and the annulus while the valve is opening and closing of the valve flap 18. The sleeve 34 also includes flow ports 68, which align with the housing flow ports 66 as the sleeve 34 descends, and before the seals 38 are brought into contact with the face 62 of the valve flap 18. This ensures that there is little or no pressure differential across the valve flap 18 during closure (and opening), as there is fluid communication between the tubing bore 48 and the annulus, as shown in FIG. 4. It will be apparent to these of skill in the art that this bypass feature will only function if there is a fluid communication route between the annulus and the lower, open end of the housing. In other words, the valve assembly in likely to be located below the tubing packer.

When the valve flap 18 is in the closed, sealed configuration of FIG. 2, the flow ports 66 and 68 of the housing 12 and the upper sleeve 34 respectively are mis-aligned, preventing fluid communication between the tubing bore 48 and the annulus. Thus the valve assembly 10 in now closed and sealed, and the tubing bore 48 is isolated from the annulus. This allows the production tubing to be uncoupled from the valve assembly, above the tubing packer, and the lower end of the bore, which intersects the production formation, to be isolated from the rest of the bore. Thus, any required well operations may be carried out above the valve assembly without impacting on the production zone.

When the well operations have been completed, for work over of the well, followed by running in and testing of replacement tubing, and coupling of the tubing to the assembly, the valve assembly 10 is returned to the open configuration shown in FIG. 1 by withdrawing fluid from the ports 42 and 46 and injecting fluid in at port 44. This allows the piston member 14 to move axially upwardly, carrying the upper sleeve 34 co-axially therewith when the shoulder 28 of the piston member. 14 comes into contact with a radially outwardly extending shoulder 35 of the sleeve 34, This causes the valve flap 18 to retract into the annular recess 20 in the wall of the housing 12. As the control fluid is withdrawn from the ports 42 and 46 and injected at port 44, the pressure of the control fluid reduces, and the lower sleeve 34 subsequently returns to its extended position under the force of the spring 54, with the valve assembly 10 in the open configuration.

Various modifications may be made to the foregoing within the scope of the present invention. For example, the above described embodiment relates to a tubing-mounted assembly, while other embodiments of the assembly may incorporated or mounted in casing or liner.

I claim:

1. A valve assembly for location in a borehole of a well, the assembly comprising:

a hollow elongate member for location in the borehole;

a valve comprising a valve member and a fluid actuated valve control mechanism adapted to be selectively actuated to move the valve member between an open configuration allowing fluid flow through the hollow member and a closed configuration where the valve member is restrained by the valve control mechanism to prevent fluid flow through the hollow member in both a first axial direction and a second, opposite axial direction;

a first hydraulic control conduit in fluid communication with the valve control mechanism for permitting actuation of the control mechanism to move the valve member to the open configuration, by application of a first control fluid; and a second hydraulic control conduit in fluid communication with the valve control mechanism to move the valve member to the closed configuration, by application of a second control fluid.

2. The assembly of claim 1, wherein the valve member comprises a plate, the plate being generally circular in plan and arcuate in profile.

3. The assembly of claim 1, wherein the valve member is disposed in a cavity in a wall of the hollow member when the valve is in the open configuration.

4. The assembly of claim 3, wherein the valve member may be isolated in the cavity, to protect the plate from well fluids and debris.

5. The assembly of claim 1, wherein the valve control mechanism comprises a plurality of independently movable fluid actuated elements.

6. The assembly of claim 5, wherein the plurality of elements are adapted to move in a predetermined sequence in response to exposure to a common fluid pressure of the first and second control fluids.

7. The assembly of claim 6, wherein the plurality of elements define different, staggered piston areas, such that pressure forces experience by various ones of the plurality of elements are different.

8. The assembly of claim 1, wherein the valve control mechanism comprises at least one element defining oppositely acting piston areas in communication with respective control conduits.

9. The assembly of claim 8, wherein the piston areas are located in respective chambers and the flow of fluid from the chambers is controllable to control piston movement.

10. The assembly of claim 1, wherein at least one of the first and second control conduits is adapted to extend out of the borehole to fluid control and supply apparatus located at surface.

11. The assembly of claim 1, wherein the at least one of the first and second control conduits is adapted to extend to a separate downhole control valve for controlling supply of fluid to the valve assembly through said at least one of the first and second control conduits.

12. The assembly of claim 1, wherein the valve assembly further comprises a bypass vent which is selectively openable to provide an alternative fluid flow path around the valve member.

13. The assembly of claim 1, wherein the fluid actuated valve control mechanism comprises first and second bodies axially moveably mounted in the hollow member, the first and second bodies adapted to be actuated to abut the valve member to restrain the valve member in the closed configuration.

14. The assembly of claim 13, wherein the first and second bodies comprise first and second sleeves.

15. The assembly of claim 1, wherein the fluid actuated valve control mechanism comprises an actuating member coupled to the valve member for moving the valve member between the closed configuration and the open configuration in response to application of the first and second control fluids.

16. A valve assembly for location in a borehole of a well, the assembly comprising:

a hollow elongate member for location in the borehole; and a valve comprising a valve member and a fluid actuated valve control mechanism adapted to be selectively actuated to allow repeated movement of the valve member between an open configuration allowing fluid flow through the hollow member, and a closed configuration where the valve member is restrained by the valve control mechanism to prevent fluid flow through the hollow member in both a first axial direction and a second, opposite axial direction, the valve control mechanism comprising a plurality of fluid actuated movable elements adapted to move in a predetermined sequence in response to exposure to a common fluid pressure.

17. The assembly of claim 16, wherein the plurality of elements define different piston areas, such that the pressure forces experienced by various ones of the plurality of elements are different.

18. A valve assembly for location in a borehole of a well, the assembly comprising:

a hollow elongate member for location in the borehole;

a valve comprising a valve member and a fluid actuated valve control mechanism adapted to be selectively actuated to allow repeated movement of the valve member between an open and a closed configuration; and a bypass vent being selectively openable to permit an alternative flow path around the valve member on closing of the valve member to provide a fluid path around the valve member.

19. A valve assembly for location in a borehole of a well, the assembly comprising:

a hollow elongate member for location in the borehole;

a valve comprising a valve member and a fluid actuated valve control mechanism adapted to be selectively actuated to move the valve member between an open and a closed configuration, for selectively allowing fluid flow through the hollow member;

a first hydraulic control conduit in fluid communication with the valve control mechanism for permitting actuation of the control mechanism to move the valve member to the open configuration, by application of a first control fluid;

a second hydraulic control conduit in fluid communication with the valve control mechanism to move the valve member to the closed configuration, by application of a second control fluid; and a bypass vent which is selectively openable to provide an alternative fluid flow path around the valve member.

20. A valve assembly for location in a borehole of a well, the assembly comprising:

a hollow elongate member for location in the borehole;

a valve comprising a valve member and a fluid actuated valve control mechanism adapted to be selectively actuated to move the valve member between an open and a closed configuration, for selectively allowing fluid flow through the hollow member;

a first hydraulic control conduit in fluid communication with the valve control mechanism for permitting actuation of the control mechanism to move the valve member to the open configuration, by application of a first control fluid; and a second hydraulic control conduit in fluid communication with the valve control mechanism to move the valve member to the closed configuration, by application of a second control fluid; and wherein the valve control mechanism comprises a plurality of independently movable fluid actuated elements adapted to move in a predetermined sequence in response to exposure to a common fluid pressure of the first and second control fluids.

21. A valve assembly for location in a borehole of a well, the assembly comprising:

a hollow elongate member for location in the borehole; and a valve comprising a valve member and a fluid actuated valve control mechanism adapted to be selectively actuated to move the valve member between an open and a closed configuration, for selectively allowing fluid flow through the hollow member, the valve control mechanism comprising a plurality of fluid actuated movable elements adapted to move in a predetermined sequence in response to exposure to a common fluid pressure, the elements defining different piston areas, such that the pressure forces experienced by the elements are different.

* * * * *

UNITED STATES PATENT AND TRADEMARK OFFICE

CERTIFICATE OF CORRECTION

PATENT NO. : 6,508,309 B1
DATED : January 21, 2003
INVENTOR(S) : Clive John French It is certified that error appears in the above-identified patent and that said Letters Patent is hereby corrected as shown below:

Title page,
Item [56], References Cited, U.S. PATENT DOCUMENTS, insert
-- 5,372,193 12/1994 French 166/250 --

Column 5,
Line 62, delete "t6" and insert -- 36 --.

Signed and Sealed this

Nineteenth Day of August, 2003

JAMES E. ROGAN
*Director of the United States Patent and Trademark Office*